294-905

9/2/86 XR 4,609,219 SR

United States Patent [19]

Go

[11] Patent Number: 4,609,219

[45] Date of Patent: Sep. 2, 1986

[54] SUSPENSION GRAPPLE

[75] Inventor: Seitaro Go, Tsuruga, Japan

[73] Assignee: Yugen Kaisha Go Chuio Tekkosho, Tsuruga, Japan

[21] Appl. No.: 591,619

[22] Filed: Mar. 20, 1984

[51] Int. Cl.[4] ..... B66C 1/34

[52] U.S. Cl. ..... 294/82.24; 294/906

[58] Field of Search ..... 294/83 R, 88, 86 R, 294/86 A, 86.15, 86.26, 86.29, 86.33, 83 A, 82 R, 81 R, 115

[56] References Cited

U.S. PATENT DOCUMENTS 3,926,467 12/1975 Crissy et al. ..... 294/83 R 3,936,089 2/1976 Hoffmeister ..... 294/86 A

*Primary Examiner*—James B. Marbert

*Attorney, Agent, or Firm*—Jones, Tullar & Cooper

[57] ABSTRACT

A suspension grapple adapted especially for use in transferring nuclear fuel assemblies to a reactor core, a fuel pool and the like. It includes a hook swingable into and out of engagement with the fuel assembly, a first lock mechanism for automatically locking the hook in lifting engagement with the fuel assembly, and a remotely operable mechanism for disabling the first lick mechanism to disengage the hook from the assembly. A second lock mechanism is provided to lock the hook out of engagement with the fuel assembly. The grapple further includes an automatic release mechanism which operates to release the hook from that out-of-engagement position and move it into lifting engagement with the fuel assembly upon the grapple abutting the assembly in a predetermined positional relationship therebetween when being lowered to engage the assembly.

8 Claims, 9 Drawing Figures

SUSPENSION GRAPPLE

BACKGROUND OF THE INVENTION

This invention relates generally to remote-control manipulator apparatus, and more particularly, to an improved suspension grapple which is adapted for use in transferring nuclear fuel assemblies to a reactor core disposed in a reactor vessel or other selected locations such as, for example, a fuel storage pool. The invention also finds utility in transferring building materials to a construction site or the like.

Known suspension grapples comprise a hook mounted to a housing for selective swinging movement into or out of engagement with an article to be lifted, and a pneumatic cylinder operatively connected with the hook to effect such swinging movement. While this arrangement permits a selective actuation of the hook by simple valve operation, the need for a pneumatic cylinder and a pump, valves, piping and other components as well complicates the overall structure of the grapple, resulting in an increased production cost. The pneumatic cylinder can be operated to actuate the hook irrespective of whether it is in or out of engagement with the article. For example, if it is desired to lift an underwater fuel assembly from the fuel pool for subsequent transfer to a certain location by remote control, difficulties arise in ascertaining whether the hook is in positive engagement with the fuel assembly, being ready for lifting. If the grapple is raised with the hook not in proper lifting engagement with the fuel assembly, the assembly might fall off during transfer.

It is, therefore, an object of this invention to provide an improved remote-control manipulator apparatus which overcomes the above-stated disadvantages of the prior art apparatus.

It is another object of this invention to provide an improved suspension grapple which is adapted for use in transferring nuclear fuel assemblies to a reactor core, a fuel pool or the like and which is easy to manipulate and relatively inexpensive to manufacture as compared to conventional pneumatically operated suspension grapples.

It is a further object of this invention to provide a suspension grapple which can be operated through entirely mechanical means, thus eliminating the need for a pneumatic cylinder.

It is still further object of this invention to provide a suspension grapple which enables an operator to ascertain the presence of a proper lifting engagement of the hook with an article to be lifted.

It is still further object of this invention to provide a suspension grapple which is provided with a hook position indicator plate capable of sending a visible signal by assuming a certain position when the hook comes into proper engagement with an article to be lifted.

It is still another object of this invention to provide a suspension grapple wherein a hook position indicator plate is adapted to send a visible signal immediately after the hook comes into proper engagement with an article to be lifted.

SUMMARY OF THE INVENTION

The objects stated above and other related objects in this invention are accomplished by the provision of a suspension grapple which comprises a hook mounted to a housing for selective swinging movement into or out of engagement with an article to be lifted, a first lock means for automatically locking the hook in engagement with the article, a manual operating mechanism for disabling the first lock means and for moving the hook out of engagement with the article, a second lock means for automatically locking the hook out of engagement with the article, and means for automatically disabling the second lock means in response to the grapple abutting the article in a proper positional relationship therebetween.

In a preferred embodiment of this invention, the hook is automatically released from the second or standby position by the automatic release mechanism which operates to disable the second lock mechanism when the grapple is moved toward a proper lifting position relative to the article wherein it may be engaged by the hook. As the grapple is moved toward the proper lifting position, the hook automatically moves to the first position to engage the article. Upon arrival at the first position, the hook is locked in that position by operation of the first lock mechanism. This will prevent start of the lifting operation when the hook is not in proper lifting engagement with the article. Also, there is no possibility that the hook unexpectedly swings out of engagement with the article during the lifting operation. Thus, this first lock mechanism will insure that the lifting operation be performed with increased safety. It should further be noted that in the present invention no troublesome manipulation is required of the respective mechanisms as well as the hook. In order to disengage the hook from the article, one single-touch manipulation of the manual operating mechanism will be necessary to release the hook from engagement with the first lock mechanism and move the hook to the second position, whereupon the second lock mechanism comes into play automatically locking the hook in that position.

Figure 1:
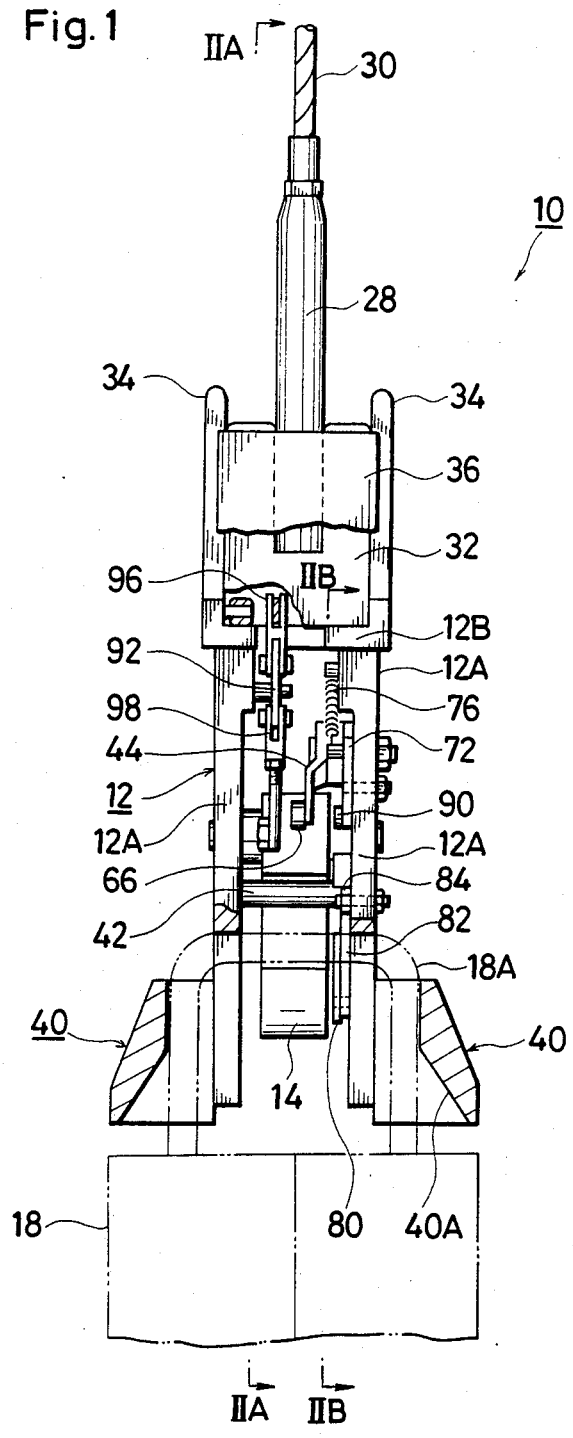
FIG. 1 is a side elevation of a suspension grapple in accordance with a preferred embodiment of this invention.

Still further advantages of this invention will be apparent from the following description of exemplary embodiments of the present invention:

DESCRIPTION OF THE PREFERRED EMBODIMENTS

Referring to FIGS. 1 to 3B which show a preferred embodiment of this invention, suspension grapple 10 includes a housing 12 comprised generally of a pair of generally identical side plates 12A and a top plate 12B affixed to the upper ends of the side plates 12A. Disposed between the side plates 12A is a hook 14 which is adapted for swinging movement about a pin 16. The pin 16 extends horizontally between the side plates 12A. The hook 14 has a first position, shown in FIGS. 3A and 3B, to enable the grapple to lift and article to be lifted such as a nuclear fuel assembly 18, and a second position, shown in FIGS. 2A and 2B, to release the article. The hook 14 tends to swing toward the first position under the influence of its weight when it is not locked by suitable means to be described below.

The grapple includes a first lock mechanism, designated generally by 20, for automatically locking the hook 14 upon its arrival at the first position, a manual operating mechanism, designated generally by 22, for disabling the first lock mechanism 20 to move the hook 14 from the first position to the second position, a second lock mechanism, designated generally by 24, for automatically locking the hook 14 upon its arrival at the second position, and an automatic release mechanism, designated generally by 26, for disabling the second lock mechanism 24 to cause the hook 14 to automatically move into the first position when the article to be lifted comes into a position ready for lifting.

Figure 3A:
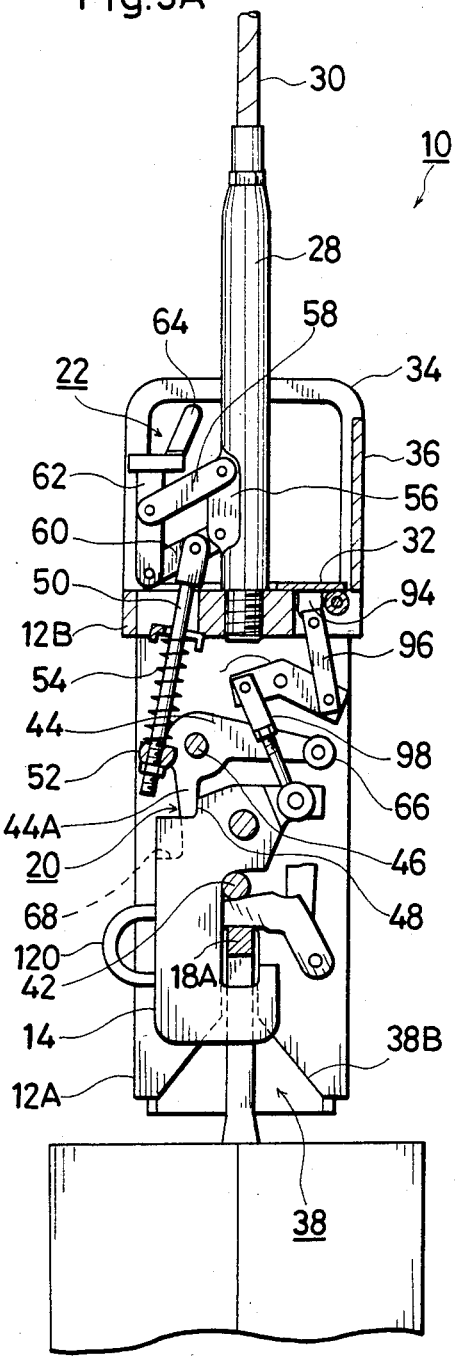
FIG. 3A is a view similar to FIG. 2A, but showing the hook locked in the first position ready for lifting a nuclear fuel assembly.
Figure 3B:
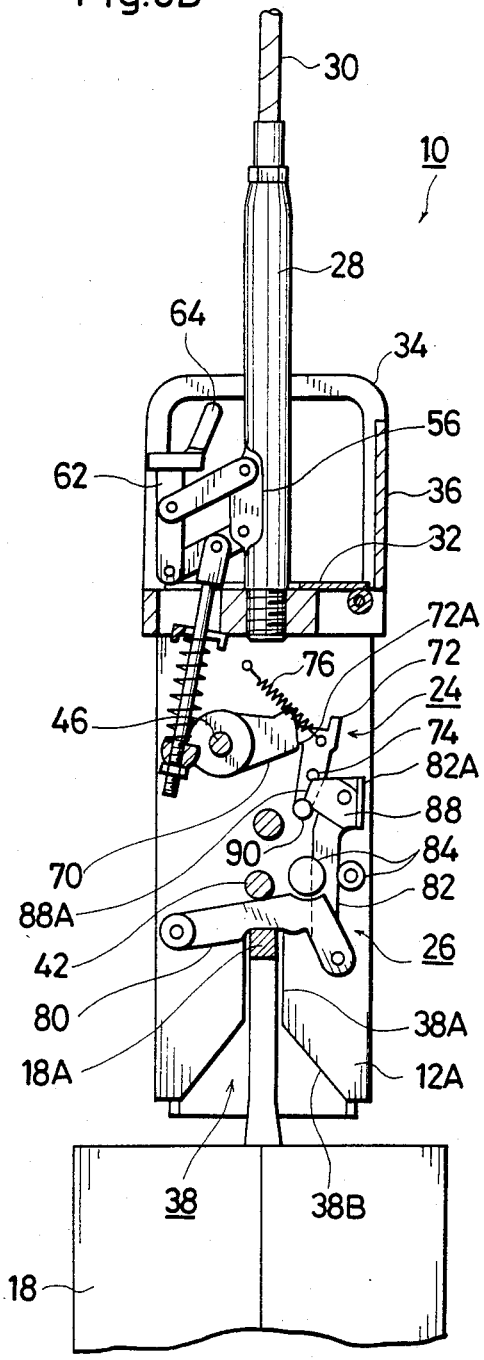
FIG. 3B is a view similar to FIG. 2B, showing the manner in which the automatic release mechanism operates to release the hook from the second position into lifting engagement with the fuel assembly.

The grapple further includes a rod 28 extending vertically upwardly from the top plate 12B of the housing 12, a wire 30 connecting the rod 28 to a crane (not shown) or the like, a hook position indicator plate 32 adapted to send a visible signal to a remote operator when the hook 14 is in the first position by assuming a horizontal position as shwon in FIGS. 3A and 3B, the indicator plate 32 being generally U-shaped with the spacing betweeen its leg portions being slightly larger than the diameter of the rod 28, a pair of vertically disposed handles 34 affixed to the top plate 12B as by welding, and a stop plate 36 vertically disposed between the handles 34. The stop plate 36 serves as a stop for the hook position indicator plate 32 when it is moving toward the vertical position. Each side plate 12A of the housing 12 has a guide groove 38 formed in its lower end. Each guide groove 38 consists of an upper vertically disposed portion 38A and a lower flared portion 38B of progressively increasing width. As shown in FIG. 1, a funnel-shaped guide member 40 is mounted to the outer surface of each side plate 12A adjacent to the guide groove 38. Each guide member 40 has an inclined guide surface 40A flaring out toward the bottom end, which facilitates the engagement of a ring portion 18A of the fuel assembly 18 by the hook 14 being lowered.

Referring to FIG. 3A, the first lock mechanism 20 is shown to comprise a stopper pin 42 for the hook 14, and a lever 44 rotatably mounted to the side plate 12A. The stopper pin 42 extends between the side plates 12A, as best seen in FIG. 1, and serves to prevent the hook 14 from making a counter-clockwise rotation, as viewed in FIG. 3A, beyond the first position illustrated. The lever 44 is disposed above the hook 14 for swinging movement about a pin 46. The lever 44 has a claw 44A formed at its one end. The claw 44A is in engagement with a reactangular groove 48 formed in the hook 14 when the hook is in the first position. A lifting rod 50 extends generally vertically upwardly from the lever 44 and is operatively connected thereto by means of a crank pin 52 rotatably mounted to the lever 44. A spring 54 is mounted on the lifting rod 50 between the crank pin 52 and the top plate 12B to urge the lever 44 in a counter-clockwise direction as viewed in FIG. 3A. This mechanism serves to hold or lock the hook 14 in the first position as shown in FIG. 3A, via claw 44A when the hook is in that position.

Figure 2A:
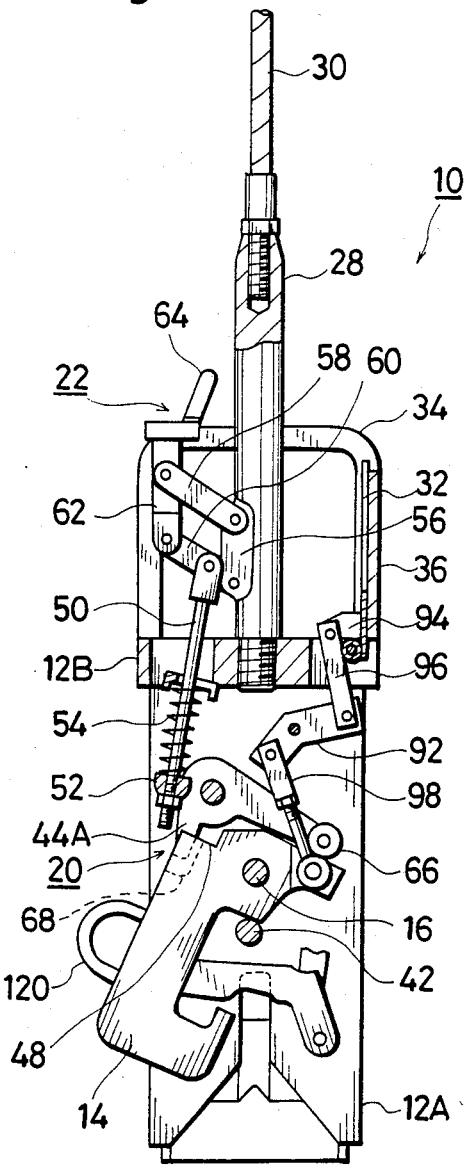
FIG. 2A is a sectional view along lines IIA—IIA of FIG. 1, showing the hook held or locked in a second position by operation of a first lock mechanism.
Figure 2B:
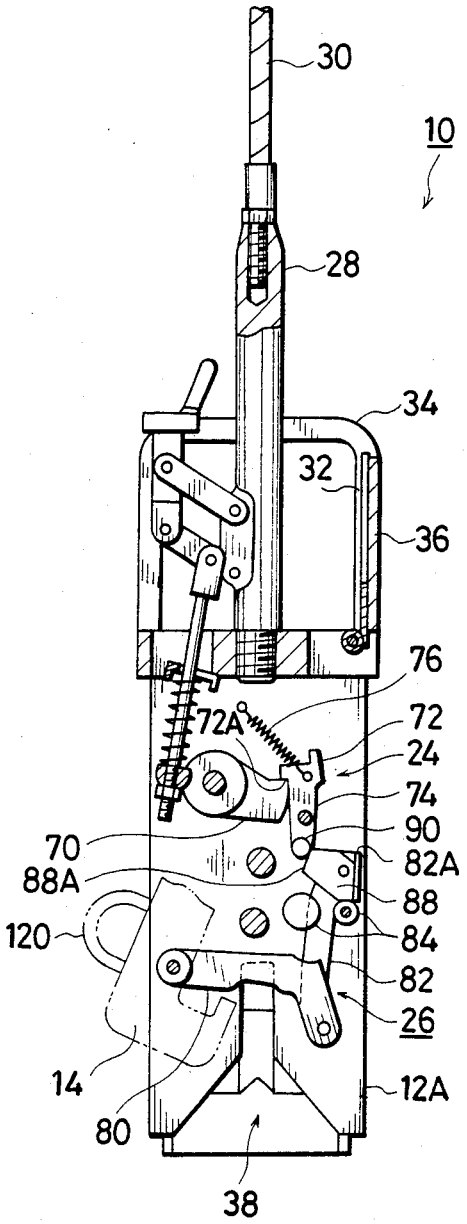
FIG. 2B is a sectional view along lines IIB—IIB of FIG. 1, showing an automatic release mechanism prior to releasing the hook from the second position toward a first position.

Referring to FIGS. 2A and 3A, the manual operating mechanism 22 has the function of disabling the first lock mechanism 20 and then moving the hook 14 from the first position of FIGS. 3A and 3B to the second position of FIGS. 2A and 2B. The mechanism 22 includes a bracket 56 affixed to the rod 28, and a pair of upper and lower links 58, 60 pivotably mounted to the bracket 56. The free ends of these links 58, 60 are pivotably interconnected by means of a link 62 which has a loop 64 affixed thereto at its upper end. Operatively connected to the lower link 60 between the respective ends thereof is the upper end of the lifting rod 50. As described above, this lifting rod 50 has the spring 54 mounted thereon between the crank pin 52 and the top plate 12B. The lever 44 has a roller 66 rotatably carried thereby at the other end thereof. The roller 66 also forms a part of the manual operating mechanism 22.

When it is desired to move the hook 14 from the first position of FIGS. 3A and 3B to the second position of FIG. 2A and 2B, the loop 64 is hooked by suitable means (not shown) and pulled upwardly. This will move the lifting rod 50 upwardly and cause the lever 44 to swing in a clockwise direction as viewed in FIG. 3A. When this occurs, the claw 44A is moved away from locking engagement with the rectangular groove 48 of the hook 14. Further lifting movement of the loop 64 will urge the roller 66 against the upper right end of the hook 14, resulting in a clockwise rotation of the hook toward the second position as shown in FIG. 2A.

In order to prevent the claw 44A from interfering with the hook 14 during its swinging movement toward the second position, the hook 14 has a cut-away portion 68 formed near the rectangular groove 48.

Referring to FIGS. 2B and 3B, the second lock mechanism 24 includes a pawl 70 which is adapted for swinging movement about the pin 46 with the lever 44. The pawl 70 and the lever 44 may be formed integral with each other. A ratchet 72 is mounted to the one side plate 12A for swinging movement about a pin 74. The ratchet 72 has a groove 72A formed therein which is adapted to be caught by the pawl 70 as shown in FIG. 2B. Once the ratchet 72 and the pawl 70 come into engagement with each other, a counter-clockwise rotation of the pawl 70 and accordingly the lever 44 is prevented which means that the hook 14 is held or locked in the second position. A spring 76 is provided between this ratched 72 and the side plate 12A to urge the ratchet 72 in a direction tending to be caught by the pawl 70.

When the hook 14 is in the first position of FIG. 3B, this ratchet 72 is urged against the arcuate surface of the pawl 70, as best seen in FIG. 3B. In this condition, the pawl 70 does not catch the ratchet 72, and it is only when the hook 14 has moved into its second position of FIG. 2B as a result of lifting the loop 64 that the pawl 70 come into catching engagement with the ratchet 72 by the action of the spring 76.

With continued reference to FIGS. 2B and 3B, the automatic release mechanism 26 includes a sensor lever 80, a push-up lever 82, and a pair of guide rollers 84 rotatably mounted to the one side plate 12A. The sensor lever 80 has one end pivotably mounted at 86 to the one side plate 12A and operates to sense that the fuel assembly 18 has been brought to a position suitable for lifting with its vertically disposed ring 18A fitting into the guide grooves 38 of the side plates 12A. The push-up lever 82 is pivotably connected at its lower end to the free end of the sensor lever 80. The guide rollers 84 serve to guide the up and down movement of the push-up lever 82 and cooperates with the push-up lever 82 to hold the sensor lever 80 in the standby position as shown in FIG. 2B. Rotatably carried by the push-up lever 82 at its upper end is a butterfly 88 having a slant cam surface 88A. When the push-up lever 82 is moved upwardly, the cam surface 88A comes into pressing engagement with a roller 90 rotatably carried by the ratchet 72 to thereby move the ratchet 72 away from catching engagement with the pawl 70, against the action of the spring 76. Counter-clockwise rotation of the butterfly 88 is prevented through its abutment against a flanged portion 82A of the push-up lever 82. However, the clockwise rotation of the butterfly 88 to escape off the roller 90 during the upward movement of the push-up lever 82 is permitted.

When the entire grapple 10 is being lowered toward the nuclear fuel assembly 18 with its top ring portion 18A slipping into the guide grooves 38, the ring portion 18A will first engage the sensor lever 80 of the automatic release mechanism 26. Further downward movement of the grapple will cause the sensor lever 80 to rotate in the counter-clockwise direction, resulting in an upward movement of the push-up lever 82. When this occurs, the butterfly 88 causes a clockwise rotation of the ratchet 72 thereby disengaging the pawl 70 therefrom so that the lever 44 is free to rotate in the counter-clockwise direction. It should thus be understood that the second lock mechanism 24 has been disabled by the operation of the automatic release mechanism 26.

For operating a suspension grapple from a remote location, it would be desirable that the operator can ascertain that the grapple is in proper lifting engagement with an article to be lifted, prior to the initiation of a lifting operation as by a crane. In accordance with a first embodiment of this invention, the grapple includes a visual hook position indicator mechanism wherein a visual signal in the form of the horizontally disposed indicator plate 32 is developed to indicate to the operator that the grapple is in such lifting engagement with the article.

Referring to FIGS. 2A and 3A, the mechanism includes a lever 92 pivotably mounted to the other side plate 12A. One end of this lever 92 and a bracket portion 94 of the hook position indicator plate 32 are pivotably interconnected by means of a link 96 which is generally square in cross section. The other end of the lever 92 and the hook 14 are pivotably interconnected by means of another link 98 which comprises a rod adapted for adjustment of its longitudinal dimension. With this arrangement, the hook position indicator plate 32 automatically moves between a horizontal position as shown in FIGS. 3A and 3B and a vertical position as shown in FIGS. 2A and 2B in response to the hook 14 swinging between the first and second positions, respectively.

In use, the suspension grapple 10 is lowered toward the fuel assembly 18 in such a manner that the ring portion 18A of the assembly 18 slips into the guide grooves 38 of the grapple. When such lowering of the grapple results in an engagement of the sensor lever 80 by the ring portion 18A, the automatic release mechanism 26 comes into action, disabling the second lock mechanism 24, that is, allowing the hook 14 to swing in the counter-clockwise direction from the second position to the first position. The first lock mechanism 20 then comes into action, automatically locking the hook 14 in engagement with the fuel assembly 18. At the same time, the hook position indicator plate 32 automatically moves from its vertical position to its horizontal position, thus enabling the operator to visually confirm that the grapple is in lifting engagement with the fuel assembly.

On the other hand, when it is desired to operate the suspension grapple to disengage the fuel assembly therefrom, it will be necessary for the operator to first hook and pull upwardly the loop 64 of the manual operating mechanism 22 through use of a suitable elongated rod (not shown). Such manipulation will disable the first lock mechanism 20 and, at the same time, cause the hook 14 to swing from the first position of FIG. 3A to the second position of FIG. 2A. The hook position indicator plate 32 is also moved from the horizontal position to the vertical position. When this occurs, it should also be noted that the hook 14 is automatically locked in the second position by operation of the second lock mechanism 24.

Referring to FIGS. 4 through 6B, there is shown a modification of the mechanism for moving the hook position indicator plate 32 between its horizontal and vertical positions in response to the hook 14 swinging between the first and second positions, respectively. In this embodiment, the hook position indicator plate 32 cannot start to move toward the horizontal position without the hook 14 having reached a ready-for-lifting position. Specifically, a lever 100 has one end rotatably mounted at 102 relative to the housing 12 and the other end linked to the bracket 94 of the position indicator plate 32 by means of a rod 104. The lever 100 also includes a roller 106 rotatably carried thereby near the center of the lever. A spring 107 provided between the link 104 and the side plate 12A urges the roller 106 against the cam surface 108A of a cam 108 rotatably mounted to the side plate 12A so that the rotation of the cam 108 determines the angular position of the lever 100 about the pin 102. The cam 108 is linked to another lever 110 by means of a rod 112. The lever 110 is rotatably mounted at 114 to the one side plate 12A. The lever 100 is also linked to the crank pin 52 by means of another rod 116. The rod 116 is pivotably connected to the lever 110 near the pin 114 so that the upward movement of the rod 116 will cause a clockwise rotation of the lever 110.

Figure 4:
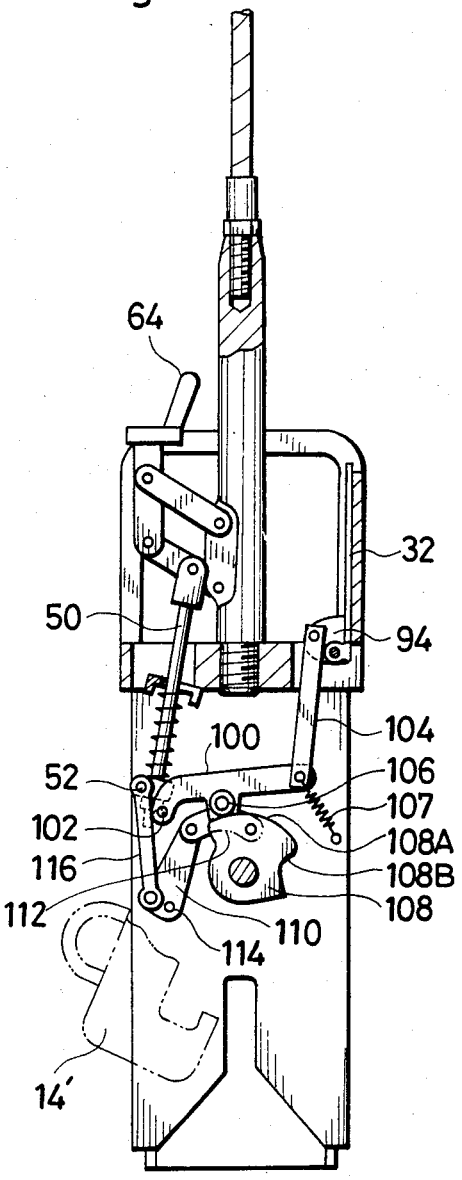
FIG. 4 shows a modification of the mechanism for moving a hook position indicator plate, with the hook being locked in the second position.

The hook 14 is shown in FIG. 4 as being held or locked in the second position by operation of the second lock mechanism 24. As described above with reference to FIG. 2B, when the sensor lever 80 is lifted by the ring 18A of the nuclear fuel assembly 18, the automatic release mechanism 26 will disengage the ratchet 72 from the pawl 70 so that the pawl 70 and accordingly the lever 44 will swing in the counter-clockwise direction thereby allowing the hook 14 to swing in the same direction as the pawl 70 and the lever 44. Since the crank pin 52 is rotatably carried by the lever 44, the counter-clockwise rotation of the lever 44 will cause a counter-clockwise rotation of the lever 110 via the rod 116. This will rotate the cam 108 in the counter-clockwise direction via the rod 112 toward the position as shown in FIG. 5.

Figure 5:
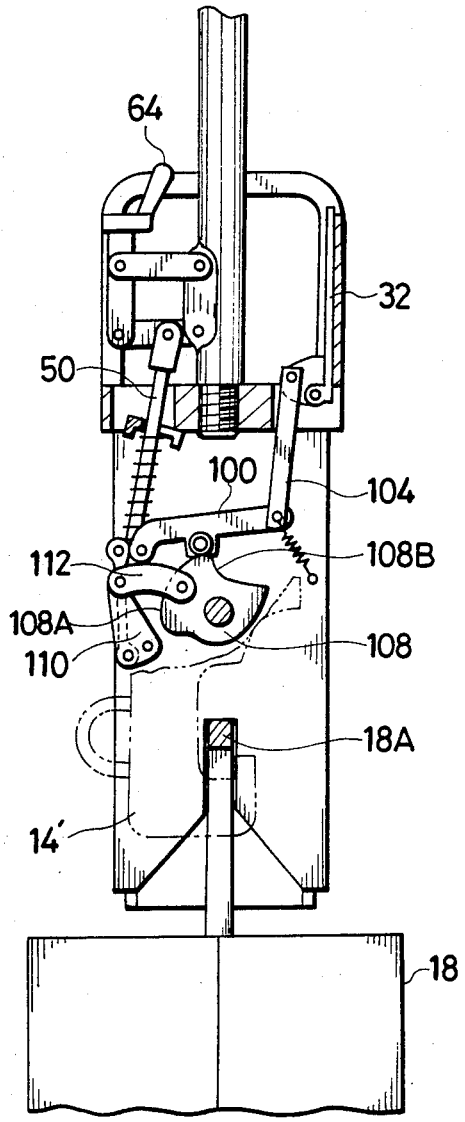
FIG. 5 is a view similar to FIG. 4, showing the hook position indicator plate just prior to moving away from its vertical position when the hook has reached a ready-for-lifting position.
Figure 6A:
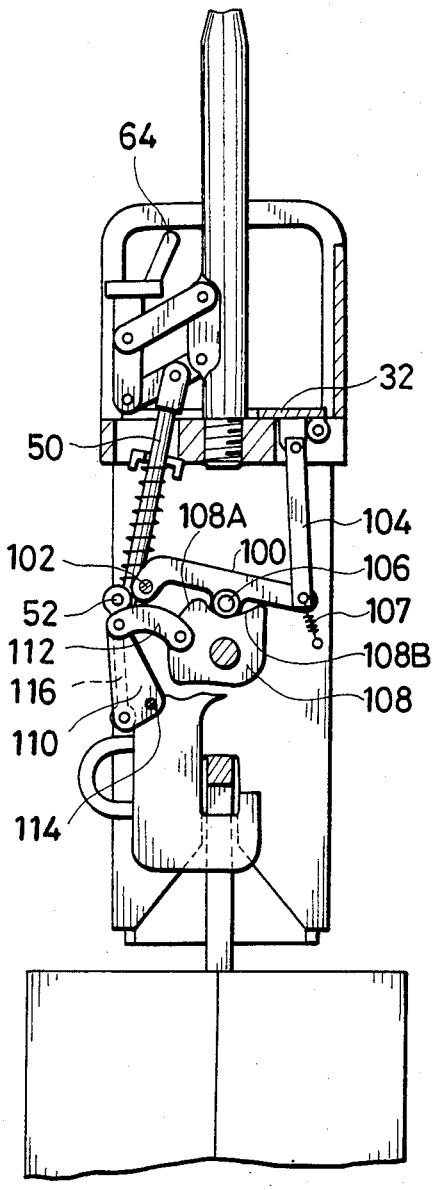
FIG. 6A shows the hook position indicator plate in a horizontal position which indicates the presence of a proper lifting engagement of the hook with the fuel assembly.

FIG. 5 shows the positions of the various components when the hook position indicator plate 32 is about to move to its horizontal position in response to the hook 14 coming to a ready-for-lifting position. It is to be noted that with the hook 14 in that position the roller 106 is located at the boundary between the convex surface 108A and concave surface 108B of the cam 108. When the cam 108 is further rotated in the counter-clockwise direction, the roller 106 will rotate along the concave cam surface 108B of the cam 53 thus causing a clockwise rotation of the lever 100, as shown in FIG. 6A. As a result, the rod 104 is moved downwardly, causing the hook position indicator plate 32 to move to the horizontal position.

In order to quickly and readily determine, from a remote location such as a fuel pool side, whether the grapple 10 is in a proper locking engagement with the fuel assembly 18, it is desirable that the front face of the hook position indicator plate 32 be painted in distinct color. Also, it is desirable that the loop 64 be painted in a color different from other components so as to be easily hooked by suitable means such as an elongated rod (not shown). For example, the loop 64 may be painted in yellow and the hook position indicator plate 32 may be painted in red.

Figure 6B:
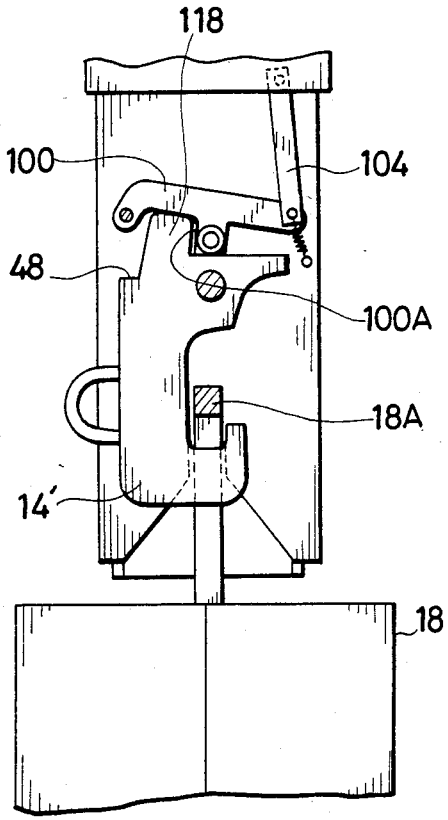
FIG. 6B shows a modified form of the hook having a notch formed therein which is adapted to latch the hook in the first position.

FIG. 6B shows a modification of the hook 14 which is adapted for use with the modified mechanism, shown in FIGS. 4 through 6A, for moving the hook position indicator plate 32 between the horizontal and vertical positions. The hook 14' shown herein is different from the hook 14 shown in FIGS. 2A to 3B in that it includes a notch 118 formed at the upper end thereof adjacent the rectangular groove 48. The notch 118 is of such a shape that it will snugly fit the latching surface 100A formed in the center portion of the lever 100, when the hook 14' is in the first position illustrated. Accordingly, it should be appreciated that in that position the hook 14' is latched by the lever 100 and that the hook 14' cannot move away from the first position unless the lever 100 is rotated in the counter-clockwise direction by rotation of the cam 108 in the clockwise direction. Such clockwise rotation of the cam 108 will occur when the loop 64 is lifted to raise the lifting rod 50 causing the lever 116 to rotate in the clockwise direction.

It is also desirable that the hook 14 be provided with an emergency handle 120 to guard against the consequence of a failure of the hook 14 to swing smoothly toward the second position by actuation of the manual operating mechanism 22 alone.

While the foregoing description has been made with regard to the suspension grapple adapted for use in handling nuclear fuel assemblies, the suspension grapple of this invention may equally be used for various other articles to be suspended, such as building materials and the like, the field of particularly favourable use being for articles to be suspended and transferred in a remote manipulation mode, such as nuclear fuel assemblies, articles which are toxic or dangerous to human bodies, and the like.

I claim:

1. A suspension grapple, comprising:

a housing;

a hook mounted to the housing for selective swinging movement into or out of engagement with an article to be lifted, the hook having a first groove formed therein;

a first lock means for automatically locking the hook in engagement with the article, the first lock means including a first lever rotatably mounted to the housing and having a claw formed at one end thereof, the first claw becoming engageable with the first groove of the hook to lock it in engagement with the article when the hook swings into such engagement with the article;

a manual operating mechanism for disabling the first lock means and for causing the hook to swing out of engagement with the article;

a second lock means for automatically locking the hook out of engagement with the article, the second locking means including a pawl mounted to the housing for rotation with the first lever, a ratchet rotatably mounted to the housing and having a groove formed therein for engagement by the pawl, and means for biasing the ratchet toward engagement with the pawl, the rotation of the first lever in one direction causing the pawl to rotate in the one direction to effect engagement with the ratchet whereby the pawl and accordingly the first lever are prevented from rotating in the other direction thereby locking the hook out of engagement with the article; and an automatic release means for moving the ratchet away from engagement with the pawl to automatically disabling the second lock means in response to the grapple abutting the article in a predetermined positional relationship therebetween.

2. The suspension grapple of claim 1, wherein the hook being in an unlocked state has a tendency to swing in a direction to effect engagement with the article under the influence of its own weight.

3. The suspension grapple of claim 2, wherein the first lever has a first roller rotatably carried thereby, and the manual operating mechanism includes manually operable means for causing the first lever to rotate in one direction, the rotation of the first lever in the one direction moving the claw away from engagement with the first groove of the hook and then urging the first roller against a portion of the hook to cause it to swing out of engagement with the article.

4. The suspension grapple of claim 3, wherein the ratchet includes a second roller rotatably carried thereby, and the automatic release means includes a sensor lever rotatably mounted to the housing and adapted to rotate in the other direction upon abutting the article in the predetermined positional relationship between the grapple and the article, a second lever pivotably connected to the sensor lever and having a butterfly rotatably carried thereby, and means for guiding the movement of the second lever and for acting as a stop for the sensor lever being in a standby position, the rotation of the sensor lever in the other direction causing the second lever to move in a manner to urge the butterfly against the second roller of the ratchet thereby rotating it in the one direction tending to disengage the pawl from the ratchet.

5. The suspension grapple of claim 1, further comprising a hook position indicator plate mounted to the housing for movement between a horizontal position and a vertical position, and means operatively connected between the hook position indicator plate and the hook so as to move the indicator plate in response to the swinging movement of the hook, the indicator plate assuming the horizontal position when the hook is in engagement with the article, and the vertical position when the hook is out of engagement with the article.

6. The suspension grapple of claim 5, wherein the means operatively connected between the hook position indicator plate and the hook comprises a third lever rotatably mounted to the housing, a first link interconnecting one end of the third lever and the hook position indicator plate and a second link interconnecting the other end of the third lever and the hook, wherein the hook position indicator plate is moved between the horizontal and vertical positions in response to the hook swinging into and out of engagement with the article, respectively.

7. The suspension grapple of claim 4, further comprising a hook position indicator plate mounted to the housing for movement between a horizontal position and a vertical position, a fourth lever having one end rotatably mounted to the housing, a third link interconnecting the other end of the fourth lever and the hook position indicator plate, a third roller rotatably carried by the fourth lever between the respective ends thereof, a first cam rotatably mounted to the housing and having a convex cam surface and a concave cam surface formed therein, a second cam rotatably mounted to the housing and having one end operatively connected to the first cam by means of a first rod, and a second rod interconnecting the second cam and the first lever so as to rotate the second cam in the other direction upon the rotation of the first lever in the same direction, wherein the rotation of the first lever caused by the actuation of the automatic release means will rotate the first lever and accordingly the second cam via the second rod causing the first cam to rotate in the other direction, whereby the third roller moves into contact with the concave cam surface of the first cam to cause the fourth lever to rotate in the one direction thereby moving the hook position indicator plate to the horizontal position via the third link.

8. The suspension grapple of claim 7, wherein the third roller is adapted to move from the convex cam surface to the concave cam surface of the first cam immediately after the hook has moved into engagement with the article.

* * * * *